US005421377A

United States Patent [19]

Bönigk

[11] Patent Number: 5,421,377

[45] Date of Patent: Jun. 6, 1995

[54] WEAVING PROCESS USING WARPS OF SIZE-FREE FLAT MULTIFILAMENT YARNS AND WOVEN FABRICS OBTAINABLE THEREBY

[75] Inventor: Burkhard Bönigk, Königsbrunn, Germany

[73] Assignee: Hoechst Aktiengesellschaft, Germany

[21] Appl. No.: 289,013

[22] Filed: Aug. 11, 1994

[30] Foreign Application Priority Data

Aug. 14, 1993 [DE] Germany ..... 43 27 371.8

[51] Int. Cl.[6] ..... D03D 15/00

[52] U.S. Cl. ..... 139/426 R; 428/225; 428/229; 139/99; 139/229

[58] Field of Search ..... 139/426 R, 99, 109; 428/225, 229

[56] References Cited

U.S. PATENT DOCUMENTS 2,985,995 5/1961 Bunting, Jr. et al. ..... 57/140

FOREIGN PATENT DOCUMENTS 58-70724 4/1983 Japan .

OTHER PUBLICATIONS

Falkai "Synthesefasern", S.334–335.

Chemiefasern/Textilindustrie, 29(10), S.862–864 (1979).

*Primary Examiner*—James J. Bell

*Attorney, Agent, or Firm*—Connolly & Hutz

[57] ABSTRACT

A process for producing woven fabrics which includes the steps of i) producing a stabilized size-free flat multifilament yarn, ii) forming a warp form the flat multifilament yarn of step i), III) leasing the warp formed in step ii) into the heddles of the shafts and into the reed of a weaving machine, and iv) producing a woven fabric through the insertion of warp threads in the transverse direction to the coarse of the warp at a weft insertion frequency of at least 300 picks/minute. The tension on the stabilized and size-free flat multifilament yarn does not exceed 1.0 cN/dtex. Also described is a woven fabric having warp threads based on stabilized flat multifilament yarns woven without size, whose warp thread density is more than 30 ends/cm and whose weft thread density is at least 30 picks/cm.

39 Claims, No Drawings

WEAVING PROCESS USING WARPS OF SIZE-FREE FLAT MULTIFILAMENT YARNS AND WOVEN FABRICS OBTAINABLE THEREBY

The present invention relates to a weaving process using size-free warp yarns and to the woven fabrics producible thereby.

Used as a warp thread in a weaving machine, a yarn is subject to a multiplicity of mechanical stresses. They include effects due to the dynamic stretching of the yarn, which can lead to loosening of the size film, to partial undoing of the intermingling, and to the abrasion between adjacent warp threads. Furthermore, the incremental passage through the warp thread guide causes an abrasion of the yarns against the lamellae; the continuous change of shed is responsible for a relative movement between adjacent filaments, resulting in abrasion and stretching of the filaments; in the heddles the filaments are subject to a multiple stress, such as rubbing or bending; the reed causes abrasion and high relative movement. In addition, the yarns are damaged by function elements of the loom, for example by relay jets, which, by cutting into the yarn, can destroy the interfilament cohesion and can cause filament breakages, which can ultimately lead to broken ends.

To render warp threads more resistant to the mechanical stress of weaving and at the same time to stick projecting fibers or filaments to the yarn, yarns are sized. The sizing of warps from the processing from natural staple fiber yarns has been known for a long time (cf. for example Falkai et al., Synthesefasern, pp. 334–5, Verlag Chemie, 1981). The size is intended to bind together the filaments of the yarn for the weaving process, but to leave the yarns readily separable from one another for shed formation.

This contradictory requirement also applies to yarns made of synthetic fibers and also to multifilament yarns. It is known that multifilament yarns with a sufficiently high cohesion due to a high level of twist need not be sized. However, imparting a high level of twist to a yarn is a complicated and particularly cost-intensive process and, what is more, has a long-lasting effect on the appearance, the tactile properties and the drape of the textile fabric produced from such yarns.

U.S. Pat. No. 2,985,995 describes a compact interlaced yarn which is virtually free of twist and can be treated without additional adhesive, such as sizes, in textile further processing operations. Although according to the description such further processing operations also include weaving, such yarns, in particular flat multifilament yarns, have hitherto not become established on the market for use as size-free warp yarns. One of the reasons why is that such yarns are prone to frequent breakage under the stresses encountered on weaving machines, so that continuous operation over a prolonged period is not possible.

Further reasons are that the trouble-free processing of such yarns does not meet the requirements of modern high-speed weaving machine systems, where the frequency of weft insertion, for example on the basis of air or water, ranges from more than 300/min to 1200/min or higher, and/or is only possible in non-critical constructions with insufficient thread density in warp and weft.

If such yarns are used for example as size-free warp yarns under the conditions prevailing on today's modern weaving machines, the result is generally failure; in particular in the case of flat multifilament yarns. These yarns either fuzz up and break in the future or they break at once or the weaving machine can be prevented by fuzz-based stoppages from running adequately or at all or at an efficiency better than an uneconomical 80%, so that continuous operation over a prolonged period is hardly possible.

JP-A-58-70,724 discloses an unsized and untwisted multifilament polyester yarn which is suitable for use as a warp yarn for producing woven fabrics. The yarn is characterized by a breaking tension of at most up to 2 g/denier. No weaving details are given.

The advantages of yarns or weaving processes requiring no high twist and no size reside not only in the economic but also in the ecological sector. On the one hand, sizing is a further process step in the production of woven fabrics and accordingly creates costs. On the other, sizes are usually removed from the fabric after weaving, which creates additional costs, wastes and environmental loads.

There is accordingly a need for yarns, weaving processes and fabrics without the use of sizes or high twist levels.

Experiments have shown that a mere raising of the degrees of intermingling of yarns—analogously to twisting to a high level—did not bring the desired success.

Intermingled yarns have hitherto been characterized by determining their degree of intermingling. This is done with the aid of known intermingling testers.

Examples are needle testers and mechanical or optical thickness/thinness sensors.

The degree of intermingling was usually reported in terms of the needle test value measured using the Rothschild needle tester model R 2040 or else in terms of the HOOK DROP test as described in U.S. Pat. No. 2,985,995; or the number of intermingling hots per unit length was measured, for example using the Reutlingen Interlace Counter or the "ITEMAT" from Enka Tecnica. Both the measurements measure the interfilament cohesion of the yarn. These methods thus provide information about the length and number of the yarn segments cohered or left open by the intermingling.

However, these methods do not make it possible to make a statement about the opening characteristics of the intermingled yarn under dynamic-mechanical stress, especially about how such a yarn will perform on use as a warp thread on a weaving machine. There have already been efforts to determine the opening characteristics of yarns. They include the inclusion of pretensioners upstream of devices for determining the interfilament cohesion, for example the inclusion of such devices upstream of the Reutlingen Interlace Counter (of. Chemiefasern/Textilindustrie, 29(10), pp. 862–4 (1979)). This makes it possible to pretension the in-test yarn uniaxially in a defined manner. However, the stress on the yarn in this case is static, which cannot adequately characterize all the possible uses, for example the characteristics of the yarn on a weaving machine.

It has further been found that—at least in the processing of critical constructions—it is beneficial for the trouble-free processing of size-free warps of flat multifilament yarns on modern, high-speed weaving machine systems if the weaving process is carried out under precisely controlled conditions.

The present invention provides a weaving process whereby warps of flat multifilament yarns can be woven without size even under the requirements of modern, high-speed weaving machine systems. The invention further provides woven fabrics which are produced without the use of sizes and which contain critical constructions as regards processing.

The invention accordingly provides a process for producing woven fabrics, comprising the steps of:

i) producing a stabilized and size-free flat multifilament yarn, ii) forming a warp from the flat multifilament yarn of step i), iii) leasing the warp formed in step ii) into the heddles of the shafts and into the reed of a weaving machine, and iv) producing a woven fabric through the insertion of weft threads in the transverse direction to the course of the warp at a weft insertion frequency of at least 300 picks/minute in a manner known per se, wherein the tension on the stabilized and size-free flat multifilament yarn, from the mechanical stabilization until after passage through the reed, does not exceed 1.0 cN/dtex, preferably 0.6 cN/dtex, in particular 0.2 to 0.5 cN/dtex.

For the purposes of the present invention, the tension on the stabilized and size-free flat multifilament yarn as per step iv) is determined using a measuring device capable of indicating even briefly arising tension peaks, for example the Denkendorf yarn tension tensor "DEFAT".

The process of the invention can be realized on all conventional weaving machine types. Examples thereof are weaving machine types where the weft thread is inserted for example using a shuttle, a projectile, a gripper or jets (water or air). Preference is given to gripper, projectile, water or air looms, in particular air looms.

Stabilized and size-free flat multifilament yarns for the purposes of the present invention are those yarn types which, at a warp thread tension as occurs under the stresses on the weaving machine and even in the case of the 1/1 plain weave known as particularly critical, are processible in a high thread density, for example at a thread density of 40/26 threads per cm in warp-/weft, not only on conventional but also and in particular on the latest weaving machine systems based on weft insertion via air or water, with virtually no faults.

This is to be understood as meaning for example that the fault factor per 1000 warp threads and 10,000 weft threads is less than 0.02 and that the efficiency is above 80%, preferably above 95%.

For the purposes of the present invention, the efficiency is the ratio of the time required in practice at the given machine settings at full speed to the theoretically required time.

The process of the invention is customarily carried out with weft insertion frequencies from 300 to 800 picks/minute, with the efficiency being above 80%, preferably above 95%. But even weft insertion frequencies of more than 800 picks/minute are possible.

Preference is given to weft insertion frequencies from 400 to 800 picks/minute.

The warp yarns used are stabilized and size-free flat multifilament yarns. A flat multifilament yarn for the purposes of this invention is a multifilament yarn which consists of a multiplicity of individual filaments and which is not a highly twisted yarn. Generally, the yarn of the invention is virtually free of twist; at most, the yarn of the invention may have a protective, producer twist—just enough twist to hold it together, for example up to 50 turns/m.

Suitable stabilized flat multifilament yarns include virtually all yarns which are composed of continuous filaments and in the course of the production or further processing of which a stabilization has taken place. This includes for example inter-rubbed, inter-welded, inter-adhered, inter-molten or in particular intermingled flat yarns.

Examples thereof are one- or multi-component flat filament yarns which have been subjected to a stabilization, such as intermingling, preferably air intermingling.

As regards the yarn-forming materials, the yarns of the invention are not subject to any restrictions, as long as yarns composed of continuous filaments can be produced therefrom. The yarns can be composed of regenerated natural polymer fibers, for example yarns composed of cellulose fibers, or in particular yarns composed of synthetic fibers, for example of polyamides, polyolefins, polyacrylonitrile or in particular polyesters, such as polyethylene terephthalate or polybutylene terephthalate.

Particular preference is given to filament yarns composed of synthetic fibers, in particular of polyester, which have very particularly preferably been air-intermingled.

The yarns can also be present in the form of filament mixtures and/or plied.

Very particular preference is given to flat yarns composed of drawn multifilaments, in particular those of the designations 76 dtex 128 filament, 100 dtex 128 filament, 76 dtex 64 filament, 50 dtex 80 filament and 50 dtex 40 filament.

Size-free flat multifilament yarn is to be understood as meaning for the purposes of this invention a flat multifilament yarn which is industrially usable in an otherwise customary weaving process and which requires no size for carrying out precisely that weaving process. However, this does not mean that this yarn cannot have any of the customary spin or fiber finishes applied to the yarn for example for carrying out or facilitating production or further processing steps prior to the actual weaving process.

In a particularly preferred embodiment of the process according to the invention, there is used a stabilized and size-free flat multifilament yarn which has a low opening tendency of the mutually bound-together filaments, expressed by the quantity $$VS(K_F) > 42\%$$

and with good cohesion, expressed by the quantity $$(VG_{mean}/VG_{max})*100\% > 45\%, \text{ especially } > 50\%,$$

the VG quantities being degrees of intermingling determined using the Rothschild needle tester model 2040, $VG_{mean}$ being the arithmetic mean of 20 needle test measurements, and $VG_{max}$ being the maximum value of 20 needle test measurements and where $VS(K_F)$ is the intermingling stability at a given total yarn tension $K_F$ determined by measuring the opening tendency of the flat multifilament yarn under dynamic-mechanical stress by the following method:

a) determining the degree of intermingling $VG_{init}$ of the flat multifilament yarn to be tested using the Rothschild needle tester R 2040, b) feeding the flat multifilament yarn into a testing zone of defined length in which the yarn path undergoes a deflection and which is formed at the beginning and end of transport devices for the yarn and of a radial force measuring device, disposed between the transport devices, the angle between the two parts of the yarn path being about 50° to about 5°, and the deflection being caused by the arrangement of the transport devices and of the radial force measuring device, and movement of the flat multifilament yarn through the testing zone under a given static yarn-pulling force, c) periodically deflecting the flat multifilament yarn moving through the testing zone at a frequency which corresponds to the change of shed frequency of a weaving machine, in particular 8 to 35 hertz, perpendicularly to the yarn axis by a predetermined length by means of a deflecting device which acts within the testing zone on the flat multifilament yarn to be tested in such a way that maximum deflection produces within the flat multifilament yarn a total yarn tension $K_F$ from 0.1 to 1.0 cN/dtex which is composed of a proportion of the static yarn-pulling force and a proportion of the dynamic yarn-pulling force acting periodically on the yarn and caused by the deflecting, d) determining the yarn-pulling force $K_F$ acting on the flat multifilament yarn during its passage through the testing zone by means of the radial force measuring device, $K_F$ being taken as the force which acts on the flat multifilament yarn between two deflections of the flat multifilament yarn due to the deflecting device, e) determining the degree of intermingling $VG_{end}$ of the yarn treated in the testing zone using the Rothschild needle tester R 2040, and f) determining the intermingling stability VS at a given yarn tension $K_F$ according to the relation $$VS(K_F)=(VG_{init}/VG_{end})*100(\%).$$

This preferred embodiment of the present invention is made possible, inter alia, by the discovery that weaving sizes can be dispensed with if yarns having a low opening tendency are used and if simple control methods are available for testing such yarns.

One such control method is the above-described method for measuring the opening tendency of the flat multifilament yarn under dynamic-mechanical stress. This method makes it possible to provide adequate simulation of weaving machine conditions and to develop yarns and also loom settings which permit the industrial use of size-free warps.

The determination of the degrees of intermingling $VG_{init}$ and $VG_{end}$ of the in-test yarn can be carried out in a manner known per se. Examples of intermingling testers are needle testers or preferably mechanical or in particular optical thickness/thinness sensors.

Examples of mechanical thickness/thinness sensors are the Reutlingen Interlace Counter as described in Chemiefasern/Textilindustrie, 29(10), pp. 862–4 (1979) and the Itemat tester for interlacing as described in Chemiefasern/Textilindustrie, 36/88, pp. 99 ff. (1986).

Examples of optical thickness/thinness sensors are described in EP-A-465,842 and EP-A-340,600; these are in the widest sense systems which, with the aid of optical methods, such as shadowing, diffraction or reflection, make it possible to correlate the measured variable with the thick/thin places of the yarn under test.

In the above-given description of the yarn to be used according to the invention, the definition included the determination of the degrees of intermingling VG with the aid of the Rothschild needle tester model 2040. However, this does not mean that the determination of VG can only be carried out with that instrument.

The term "degree of intermingling" is to be understood within the meaning of this description as a measured value which is attained on testing the yarn to be used according to the invention, i.e. even a non-intermingled yarn (for example a welded-together yarn), with an intermingling tester. This variable measures the interfilament cohesion of the yarn, i.e. the length and number of the cohered or open yarn segments.

The control method described makes it possible to determine the change in the cohesion and/or the degree of intermingling of the yarn to be used according to the invention under realistic conditions under a given static yarn tension and under an additional dynamic-mechanical load.

To simulate the tension on the yarn in the testing zone, the yarn is subjected within the zone to a deflection and is guided under a predetermined and non-pulse-like tension. For this purpose the yarn undergoes a single instance within the testing zone of a deflection, the angle between the two parts of the yarn path being about 50° to about 5°, and the deflection being caused by the arrangement of the transport devices and of the radial force measuring device.

To simulate the tension on the yarn within the testing zone, the yarn is transported between two transport devices under a given static tension. This tension can be controlled in a manner known per se, for example by controlling the speed of the transport rollers.

During the test, the static yarn tension is monitored by means of the yarn-pulling force measuring device.

Within the testing zone the yarn is thus guided under a predetermined and non-pulselike tension.

The transport devices can be any device suitable for yarn transportation. Examples are commercially available, motor-driven godets or else delivery systems, preferably frequency-controlled.

Preferably the transport devices are pairs of rollers around which the in-test yarn is guided repeatedly and whose speed can be controlled separately. This makes it possible for example to simulate the tension in a warp in the course of its production or processing on the loom.

The yarn-pulling force measuring device can likewise be any device suitable for this purpose. Examples are the Rothschild Tensiometer, the Honigmann Tensitron, the Denkendorf yarn tension tensor, and the yarn tension meter from REES.

The length of the testing zone can vary within wide limits; typical values range from 50 to 3000 cm, preferably from 150 to 200 cm (weaving machine dimensions).

To simulate the additional dynamic-mechanical load on the yarn within the testing zone, the yarn undergoes within the testing zone a periodical deflection perpendicularly to the yarn axis about a predetermined length and at a predetermined frequency. This is done by means of a deflecting device which acts on the in-test yarn within the testing zone. The deflecting device can be any apparatus suitable for this purpose.

Examples of deflecting devices are pistons or cams working perpendicularly to the yarn axis and in particular wings which rotate perpendicularly to the yarn axis and which exert a beat, defined in terms of amplitude and frequency, on the moving yarn.

The frequency of the deflecting device can likewise vary within wide limits; similarly the amplitude of the tension pulses to be applied to the yarn. For the purposes of the present invention, frequency and tension pulses are chosen within an order of magnitude so as to simulate the behavior of a warp in a weaving machine.

Typical values of the frequency of the deflecting device range from 5 to 50 Hz, preferably within the range from 8 to 35 Hz.

Typical values of the magnitude of the tension pulses to be applied to the yarn are within such a range that the total tension on the yarn—i.e. the sum total of static yarn tension and proportion of the periodic tension on the yarn (values of the tension amplitude)—vary within the range from 0.05 to 1.0 cN/dtex, preferably within the range from 0.1 to 0.7 cN/dtex.

To test the yarn in respect of size-free weavability at a given warp tension in the weaving machine, the total tension is preferably chosen to be at least equal to the warp thread tension occurring on the weaving machine.

Very particular preference is given to using the above-described process for characterizing warps. For this purpose the yarn is passed through the testing zone in the form of a warp. The testing takes place either successively on individual yarn strands or on a plurality of yarn strands of the warp or else on all yarn strands of the warp. Preferably such warps consist of two to five yarns; preferably the deflecting device acts on a plurality of such yarns.

The control method described yields as measured variables the degrees of intermingling $VG_{init}$ and $VG_{end}$, for example as the number of intermingling nodes per unit length of the yarn.

One test parameter is the opening tendency of the yarn according to the invention under the testing conditions in the testing zone.

The evaluation of the measured-variables $VG_{init}$ and $VG_{end}$ at a given total yarn tension $K_F$ can be carried out in various ways.

The ratios $VG_{init}/VG_{end}$ and $VG_{end}/VG_{init}$ at a certain total yarn tension $K_F$ are a characteristic of the behavior of the yarn under dynamic-mechanical load.

For the purpose of describing preferred yarns to be used according to the invention, the measure of opening tendency under dynamic-mechanical stress on these yarns is taken to be an intermingling stability $VS(K_F)$ at a certain total yarn tension $K_F$ and under a certain tension pulse of a given frequency according to the relation $$VS(K_F)=(VG_{init}/VG_{end})*100(\%).$$

The total yarn tension $K_F$ is for the purposes of the present description taken to be the sum total of static yarn tension and a proportion of the dynamic yarn tension acting periodically on the yarn and caused by the deflecting and prevailing in the deflected yarn in the course of its transport through the testing zone.

The distribution of the measured values of the degrees of intermingling VG of yarns usually conforms to a Poisson function. This function, however, is—assuming the same means—dependent on different parameters, such as yarn material, the conditions during the creation of the cohesion and yarn transportation conditions, and varies greatly in its width.

The control method described makes it possible, in addition to the means of the distribution of the degree of intermingling for a certain yarn, to provide an additional and more meaningful criterion for the cohesion of the yarn.

It was found that especially the use as a size-free warp yarn makes it problematical to operate with the means of the distribution of the degrees of intermingling. It was further found that it is advisable here to use, instead of these means of the degree of intermingling, the extreme values of a series of measurements, since they generally determine the running characteristics of these yarns on a weaving machine.

It was found that the running behavior of flat multifilament yarns on a weaving machine presupposes good cohesion as characterized by the above-defined variable $(VG_{mean}/VG_{max})*100\% > 45\%$, preferably $>50\%$, in particular $>67\%$, particularly preferably 55 to 67%.

In a further preferred embodiment, the yarn to be used according to the invention, in addition to the above-indicated variables $VS(K_F)$ and $VG_{mean}/VG_{max}$, has $VG_{max}$ values $<30$ mm, preferably from 11 to 22 mm, in particular from 18 to 22 mm, determined using the Rothschild needle tester model 2040.

In a further preferred embodiment, the yarn to be used according to the invention, in addition to the above-indicated variables $VS(K_F)$ and $VG_{mean}/VG_{max}$, has $LK_{mean}$ values $<15$ mm, preferably $<6.0$ mm, particularly preferably 1.6 to 5.6 mm, where $LK_{mean}$ is the mean length between the intermingling nodes determined according to the relation $$LK_{mean}=(1000-(VG_{mean}*IL_{mean}))/IL_{mean}$$

where $VG_{mean}$ is as defined above, determined via the Rothschild needle tester model 2040, and $IL_{mean}$ is the mean number of intermingling nodes per yarn meter determined using the Reutlingen Interface Counter or an ITEMAT.

Preferred flat multifilament yarns to be used according to the invention have $VS(K_F)$ values ranging from 60 to 100%.

Particular preference is given to the use of flat multifilament yarns, as defined above, whose $VS(K_F)$ value is 45–90% measured at a frequency of 15 hertz and at such a maximum deflection in step c) that the maximum deflection produces in the flat multifilament yarn a total yarn tension $K_F$ from 0.2 to 0.42 cN/dtex.

The filament linear density of the flat multifilament yarns to be used according to the invention can vary within wide limits; typically this linear density is from 0.3 to 6.5 dtex, preferably from 0.6 to 1.5 dtex, and very particularly preferably less than 1.0 dtex.

The yarn linear density of the flat multifilament yarns to be used according to the invention can likewise vary within wide limits; typically this yarn linear density is 20 to 600 dtex, preferably 40 to 400 dtex. The number of filaments in the flat multifilament yarn to be used according to the invention is typically within the range from 20 to 200, preferably from 40 to 180.

Types having lower filament counts are particularly difficult to use as warp yarns. It is therefore particularly surprising that such yarns are still satisfactorily weavable without size without difficulties.

The invention preferably relates to a weaving process as defined above using flat multifilament yarns having filament counts of more than 20, in particular of more than 30.

The flat multifilament yarns to be used according to the invention have adequate strength; in the case of flat polyester yarns the breaking strengths are more than 2 g/denier, preferably more than 3 g/denier.

Usually the flat multifilament yarns to be used according to the invention are fluid-intermingled multifilament yarns, preferably air-intermingled multifilament yarns.

To produce the stabilized and size-free flat multifilament yarns to be used according to the invention, these have to be produced with sufficient cohesion and sufficient opening tendency for size-free weaving. It was found that such yarns can be produced and processed when the yarn is guided from the site of production (stabilization), especially intermingling, and from there to the production of the ready-produced greige fabric with low tension and preferably not only with low tension but with a particularly constant tension.

The process of the invention is particularly preferably carried out in such a way that, at the site of intermingling and during weaving, the yarn tension is kept particularly constant, in particular that the fluctuation in the yarn tension is less than +/−0.1 cN/dtex. This constancy in the tension is achievable by measures known per se, for example by controlling and regulating delivery systems or godets by means of frequency rectifiers.

The feed yarns used for the production of the stabilized and size-free flat multifilament yarns can be any desired single- or multi-component filament yarns; these yarns are generally drawn prior to being intermingled, provided they are not filament yarns which have been spun at very high speeds and are no longer drawable.

The feed yarns are customarily fully drawn yarns, i.e. yarns whose ultimate tensile strength extension at 25° C. is less than 80%.

The orienting and drawing of the yarns can be carried out in a manner known per se. For instance, a fully oriented yarn (FOY) can be produced during the spinning process itself and this yarn need generally no longer be drawn; or it is possible to produce a yarn which can be made into a drawn yarn in a subsequent afterdrawing process. These latter afterdrawable yarns are usually LOY, MOY, HOY or POY yarns. The terms LOY, MOY, HOY, POY and FOY are common knowledge and described for example in Chemiefasern/Textilindustrie, 6/1985, pp. 411–2.

The drawing can directly adjoin the spinning process or be carried out in a separate stage, for example combined with a customary aftertreatment, such as setting.

The drawing can also take place directly prior to feeding into the intermingling unit, for example by means of upstream drawing godets. This variant can be carried out within an aftertreatment zone or integrated in the spinning process upstream of the site of intermingling.

The drawing and intermingling can be carried out successively in one stage, for example by intermingling an FOY yarn directly in the spinning chimney prior to the winding up of the yarn. However, it can also be carried out in a subsequent process, for example by rewinding or recopsing.

The drawing and intermingling can also be carried out in two or more stages. For instance, yarns can be partially oriented during spinning, for example as LOY, MOY or POY yarns, and can then be drawn in a subsequent stage, for example in the course of draw-winding or draw-twisting. Here the intermingling takes place in a subsequent process stage, after the yarn was drawn and before it is wound up.

It is possible to choose single- or multi-component yarns which enter the intermingling unit in single or else multiple form and leave it in either case as a compact yarn.

The intermingling can also be carried out in multiple stages, in which case the yarn passes through a plurality of intermingling jets connected in series.

The presentation and feeding of the multifilament feed yarn to the intermingling unit is effected by measures and devices customary per se. In the blasting jet texturing of yarns it is well known that the filament material is fed into the blasting jet at a higher speed than it is withdrawn therefrom. The amount by which the speed of the feeding in exceeds the speed of the withdrawal, expressed in percent based on the withdrawal speed, is known as the overfeed. Care has to be taken during feeding that the overfeed of the multifilament feed yarn is such as to produce a virtually fuzz- and loop-free yarn. This is customarily the case with overfeeds of less than 3%. In individual cases, however, it is also possible to use higher overfeeds, provided the product yarn is a smooth, intermingled yarn, preferably a flat multifilament yarn which meets the above-defined values in respect of the opening tendency and the interfilament cohesion.

The intermingling of the multifilament feed yarn in the intermingling Jet is effected by means of a fluid, for example by means of liquids or in particular by means of gases. Air is preferred. The intermingling pressure must be chosen in such a way in any particular case that the required maximum limit for the yarn tension at the site of intermingling is not exceeded and that a flat yarn is formed. Typical values for the intermingling pressure range from 1.5 to 7.5 bar. However, higher pressures are also possible.

Preferably the feed yarn is intermingled with air in the presence of a liquid which wets the feed yarn during the intermingling process, for example water.

Examples of intermingling/interlacing jets are found in U.S. Pat. No. 2,985,995 whose disclosure content is also part of the subject-matter of the present invention.

After intermingling, the flat multifilament yarn formed is withdrawn from the intermingling unit. This can be done by means of devices known per se, for example with godets. In choosing the take-off tension, care has to be taken to ensure that the tension on the yarn at the site of intermingling is not greater than 0.6 cN/dtex, preferably from 0.1 to 0.4 cN/dtex.

The intermingled flat multifilament yarn can subsequently be subjected to a setting treatment by passing it through a heating device; typical temperatures of the yarn passing through the heating device vary within the range from 60° to 250° C.

The stabilization described can be carried out on individual, folded or unfolded yarns, which are subsequently wound up and processed in a further step into a warp. However, the process can also be integrated into the production of warp beams by carrying out the intermingling by means of a multiplicty of parallel intermingling jets on the yarn sheet contemplated for producing the warp beam. Examples of such integrated processes are found in DE-B-2,611,547, EP-A-152,919, DE-A-3,711,767 and DE-A-3,727,262.

In the embodiment of the stabilization process described which involves more than one intermingling jet, for example with a plurality of intermingling Jets connected in series or in parallel, the intermingling conditions can be kept identical or else different at each of these jets; especially it is possible to vary the nature of the jets or process parameters such as yarn tension, intermingling pressure or the application of liquid to the yarn upstream and/or downstream of the site of intermingling.

The further processing of the stabilized and size-free flat multifilament yarns takes place in a conventional manner of warp preparation, for example by direct or section warping. For this the yarn requires no further aftertreatment; if desired, however, it can be conventionally afteroiled or afterwaxed in order that its sliding properties on and/or against the machine parts of the loom may be improved, preferably in order that the friction coefficients of the yarn against yarn guide elements, in particular lamellae, heddles and reed, may be reduced.

This afteroiling or afterwaxing takes place downstream of the site of intermingling, for example upstream of a first winding or during a rewinding process or draw-winding process or in the course of warp preparation.

It is possible to use all commonly used weaving warp beam formats. Preference is given to weaving warp beams having a width from 1.50 to 1.80 m; these weaving warp beams carry for example from 6000 to 8000 ends in a density of 40 ends/cm.

It is known per se that warps having high thread densities are particularly difficult to weave. It is all the more surprising that the yarn to be used according to the invention is weavable without size in the form of warps having high thread densities.

The invention therefore also provides a weaving process using warps having thread densities of more than 30 ends/cm, in particular greater than 40 ends/cm.

The weft yarns used can be all textile or industrial yarns, such as spun yarns or flat or textured multifilament yarns. Multicomponent yarns are also usable.

The weft yarn materials used can be any materials used in textiles or industrial fabrics, such as the yarns mentioned above in the description of the warp yarns, composed of regenerated natural polymer fibers or yarns composed of synthetic fibers; it is also possible to use yarns composed of natural fibers.

Preferred examples of weft yarn materials are polyamides, polyolefins, polyacrylonitrile, polyester, viscose, cotton and wool.

Preference is given to weft yarns composed of synthetic fibers, especially polyester, which have been very particularly preferably textured or air-intermingled. Of the textured polyester weft yarns, especially 167 dtex 32 filament yarn, 150 dtex 240 filament yarn or 100 dtex 160 filament yarn are preferred; of the air-intermingled polyester weft yarns, especially 167 dtex 32 filament yarn is preferred. Of spun yarns, especially viscose or polyester yarns are preferred, especially singles yarn of metric count 34.

The process of the invention makes it possible to produce any desired woven constructions; preference is given to twill and satin/sateen weaves in all their variants. Very particular preference is given to plain weaves.

Preferred weft thread densities in the case of plain weaves are more than 20 picks/cm.

The invention also provides a woven fabric comprising warp threads based on stabilized flat multifilament yarns woven without size, whose warp thread density is more than 30 ends/cm and whose weft thread density is more than 20 picks/cm.

The invention provides in particular such a fabric in a plain weave.

The Examples which follow illustrate the invention without limiting it.

EXAMPLE 1

Production of a Size-Free Woven Fabric from a Flat Yarn Warp of 50 dtex 40 Filament FOY The feed yarn used was a singles polyethylene terephthalate 50 dtex 40 filament FOY with a round filament cross section. The yarn was spun in a manner known per se, for example as described in DE-A-2,117,659.

The feed yarn thus produced was rewound on a winding machine to produce an intermingled yarn. In the course of the rewinding the yarn was air-intermingled at a frequency of 1100 knots/second. The yarn tension at the point of entry into the intermingling jet was kept particularly constant and was less than 0.6 cN/dtex. The wind-up tension was likewise less than 0.6 cN/dtex.

The ready-produced yarn has the following characteristic data:

| Total yarn tension $K_F$ (cN/dtex) | $VS(K_F)$ (%) | $VG_{mean}$ (mm) | $VG_{max}$ (mm) | $IL_{mean}$ (1/m) | $LK_{mean}$ (mm) |
|---|---|---|---|---|---|
| unloaded | 100 | 12 | 18 | 76 | 2.5 |
| 0.2 | 96 | 12 | 18 | 73 | 2.0 |
| 0.4 | 86 | 12 | 22 | 65 | 1.6 |
| 0.6 | 57 | 21 | 65 | 43 | 1.3 |

The variables of the above table were determined by the following methods:

$K_F$: Total yarn tension determined with the Denkendorf yarn tension tensor (DEFAT)

$VS(K_F)$ Opening tendency (as defined above) determined with the Rothschild needle tester model R 2040

$VG_{mean}$ Mean needle test value (arithmetic mean of 20 measurements) determined with the Rothschild needle tester model R 2040

$VG_{max}$ Maximum needle test value (greatest value of 20 measurements) determined with the Rothschild needle tester model R 2040

$IL_{mean}$ Mean number of intermingling nodes per yarn meter determined with the Reutlingen Interlace Counter $LK_{mean}$ Mean length between intermingling hots calculated according to the relation $(1000-(VG_{mean}*IL_{mean}))/IL_{mean}$ The ready-produced yarn was beamed in 6880 ends onto a weaver's warp beam in a density of 40 ends/cm. This warp was processed on a RÜTI air weaving machine of the type L-5000 at 530/min. The fabric woven has a plain weave with 26 picks of a singles viscose yarn of metric count 34 and singles 167 dtex 32 filament textured polyester. The tension in the warp during weaving was always less than 0.6 cN/dtex. The fault factors per 1000 warp threads and 10,000 weft threads were below 0.02.

EXAMPLE 2

Production of a Size-Free Woven Fabric from a Flat Yarn Warp of 76 dtex 128 Filament FOY The feed yarn used was a singles polyethylene terephthalate 76 dtex 128 filament FOY. The yarn was spun in a manner known per se, for example as described in DE-A-2,117,659.

During this spinning process, the yarn was air-intermingled at a frequency of 5500 hots/second. The yarn tension at the point of entry into the intermingling jet was kept particularly constant and was less than 0.6 cN/dtex. The wind-up tension was likewise less than 0.6 cN/dtex.

The ready-produced yarn is distinguished in the unloaded state by the following characteristic data: $VG_{mean}$=9 mm and $VG_{max}$=29 mm.

The quantities $VG_{mean}$ and $VG_{max}$ were determined as described in Example 1.

This ready-produced yarn was beamed in 6880 ends onto a weaver's warp beam in a density of 40 ends/cm. This warp was processed on a RÜTI air weaving machine of the type L-5000 at 530/m. The fabric woven was a plain weave with 21 to 32 weft threads of polyester of varying linear densities: 100 dtex 160 filament text; 150 dtex 240 filament×1 text; 167 dtex 32 filament text; and 167 dtex 256 filament jet tex. The yarn tension in the warp during weaving was always less than 0.45 cN/dtex. The fault factors per 1000 warp threads and 10,000 weft threads were below 0.02.

EXAMPLE 3

Production of a Size-Free Flat Yarn Warp from 76 dtex 128 Filament FOY

The feed yarn used was a polyethylene terephthalate 76 dtex 128 filament FOY. The yarn was spun in a manner known per se, for example as described in DE-A-2,117,659.

The feed yarn thus produced was rewound on a winding machine to produce an intermingled yarn. In the course of the rewinding, the yarn was air-intermingled at a frequency of 1700 hots/second. The yarn tension at the point of entry into the intermingling jet was kept particularly constant and was less than 0.6 cN/dtex. The wind-up tension was less than 0.6 cN/dtex.

The ready-produced yarn has the following characteristic data:

| Total yarn tension $K_F$ (cN/dtex) | $VS(K_F)$ (%) | $VG_{mean}$ (mm) | $VG_{max}$ (mm) | $IL_{mean}$ (1/m) | $LK_{mean}$ (mm) |
|---|---|---|---|---|---|
| unloaded | 100 | 7.5 | 12.5 | 89 | 4.2 |
| 0.13 | 100 | 7.1 | 11.1 | 85 | 4.8 |
| 0.40 | 100 | 7.1 | 15.2 | 85 | 4.8 |
| 0.66 | 88 | 8.0 | 14.1 | 73 | 5.6 |

The variables of the above table were measured by the following methods:

$K_F$: Total yarn tension determined with the Denkendorf yarn tension tensor (DEFAT)

$VS(K_F)$ Opening tendency (as defined above) determined with the Rothschild needle tester model R 2040

$VG_{mean}$ Mean needle test value (arithmetic mean of 40 measurements) determined with the Rothschild needle tester model R 2040

$VG_{max}$ Maximum needle test value (greatest value of 40 measurements) determined with the Rothschild needle tester model R 2040

$IL_{mean}$ Mean number of intermingling nodes per yarn meter determined with the Reutlingen Interlace Counter $LK_{mean}$ Mean length between intermingling hots calculated according to the relation $(1000-(VG_{mean}*IL_{mean}))/IL_{mean}$ This ready-produced yarn was beamed in 6000 ends onto a weaver's warp beam in a density of 40 ends/cm. This warp was processed on a RÜTI air weaving machine of the type L-5000 at 550/min. The fabric woven was a plain weave with 21 to 26 weft threads of 167 dtex 32 filament polyester. The change of shed frequency was 9 Hz. The yarn tension in the warp during weaving was always less than 0.52 cN/dtex. The fault factors per 1000 warp threads and 10,000 weft threads were below 0.02.

What is claimed is:

1. A process for producing woven fabrics, comprising the steps of:

i) producing a stabilized and size-free flat multifilament yarn, ii) forming a warp from the flat multifilament yarn of step i), iii) leasing the warp formed in step ii) into the heddles of the shafts and into the reed of a weaving machine, and iv) producing a woven fabric through the insertion of weft threads in the transverse direction to the course of the warp at a weft insertion frequency of at least 300 picks/minute in a manner known per se, wherein the tension on the stabilized and size-free flat multifilament yarn, from the mechanical stabilization until after passage through the reed, does not exceed 1.0 cN/dtex.

2. The process of claim 1, wherein the tension on the stabilized and size-free flat multifilament yarn, from the stabilization until after passage through the reed, does not exceed 0.6 cN/dtex.

3. The process of claim 2, wherein the tension on the stabilized and size-free flat multifilament yarn, from the stabilization until after passage through the reed, is between 0.2 and 0.5 cN/dtex.

4. The process of claim 1, wherein the production of the woven fabric takes place on a gripper, projectile, water or air loom.

5. The process of claim 1, wherein the production of the fabric takes place at a weft insertion frequency from 400 to 800 picks/minute.

6. The process of claim 1, wherein the stabilized and size-free flat multifilament yarns used are filament yarns composed of polyester, in particular polyethylene terephthalate.

7. The process of claim 1, wherein the stabilized and size-free flat multifilament yarns used are air-intermingled filament yarns.

8. The process of claim 1, wherein the stabilized and size-free flat multifilament yarns used have have an intermingling stability VS of $$VS(K_F)>42\%$$

and having a ratio of the arithmetic means of 20 needle test measurements to the maximum value of 20 needle test measurement of $$VG_{mean}/VG_{max})*100\%>45\%$$

the VG quantities being degrees of intermingling determined using the Rothschild needle tester model 2040, $VG_{mean}$ being the arithmetic $_{mean}$ of 20 needle test measurements, and $VG_{max}$ being the maximum value of needle test measurements and where $VS(K_F)$ is the intermingling stability at a given total yarn tension $K_F$ determined by measuring the opening tendency of the flat multifilament yarn under dynamic-mechanical stress by the following method:

a) determining the degree of intermingling $VG_{init}$ of the flat multifilament yarn to be tested using the Rothschild needle tester R 2040 b) feeding the flat multifilament yarn into a testing zone of defined length in which the yarn path undergoes a deflection and which is formed at the beginning and end of transport devices for the yarn and of a radial force measuring device, disposed between the transport devices, the angle between the two parts of the yarn path being about 50° to about 5°, and the deflection being caused by the arrangement of the transport devices and of the radial force measuring device, and movement of the flat multifilament yarn through the testing zone under a given static yarn-pulling force, c) periodically deflecting the flat multifilament yarn moving through the testing zone at a frequency which corresponds to the change of shed frequency of a weaving machine, in particular 8 to 35 hertz, perpendicularly to the yarn axis by a predetermined length by means of a deflecting device which acts within the testing zone on the flat multifilament yarn to be tested in such a way that maximum deflection produces within the flat multifilament yarn a total yarn tension $K_F$ from 0.1 to 1.0 cN/dtex which is composed of a proportion of the static yarn-pulling force and a proportion of the dynamic yarn-pulling force acting periodically on the yarn and caused by the deflecting, d) determining the yarn-pulling force $K_F$ acting no the flat multifilament yarn during its passage through the testing zone by means of the radial force measuring device, $K_F$ being taken as the force which acts n the flat multifilament yarn between two deflections of the flat multifilament yarn due to the deflecting device, e) determining the degree of intermingling $VG_{end}$ of the yarn treated in the testing zone using the Rothschild needle tester R 2040, and f) determining the intermingling stability VS at a given yarn tension $K_F$ according to the relation $$VS(K_F)=(VG_{init}/VG_{end})*100(\%).$$

9. The process of claim 8, wherein the stabilized and size-free flat multifilament yarns used have good cohesion of the mutually bound-together filaments, expressed by $$(VG_{mean}/VG_{max})*100\%>67\%.$$

10. The process of claim 8, wherein the stabilized and size-free flat multifilament yarns used have a degree of intermingling $VG_{max}<30$ mm, where $VG_{max}$ is determined by the method defined in claim 8 using the Rothschild needle tester models 2040, $VG_{max}$ being the maximum value of 20 needle test measurements.

11. The process of claim 8, wherein the stabilized and size-free flat multifilament yarns used having a mean length $LK_{mean}$ between intermingling nodes $LK_{mean}<15$ mm where $LK_{mean}$ is the mean length between the intermingling nodes determined according to the relation $$LK_{mean}=(1000*IL_{mean}))/IL_{mean}$$

where $VG_{mean}$ is the arithmetic $_{mean}$ of 20 needle test measurements determined via the Rothschild needle tester model 2040, and $IL_{mean}$ is the mean number of intermingling nodes per yarn meter determined using the Reutlingen Interlace Counter or an ITEMAT.

12. The process of claim 8, wherein stabilized and size-free flat multifilament yarns are used whose opening tendency $VS(K_F)$ is 45–90% measured at a frequency of 15 hertz and at such a maximum deflection in step c) that the maximum deflection produces in the flat multifilament yarn a total yarn tension of up to 0.42 cN/dtex.

13. The process of claim 8, wherein the stabilized and size-free flat multifilament yarns used have $(VG_{mean}/VG_{max})*100\%$ of more than 55%.

14. The process of claim 8, wherein the stabilized and size-free flat multifilament yarns used have $VG_{max}$ of 18 to 22 mm.

15. The process of claim 8, wherein the stabilized and size-free flat multifilament yarns used have a mean length LK between the intermingling nodes $LK_{mean}$ of 1.6 to 2.0 mm.

16. The process of claim 8, wherein the stabilized and size-free flat multifilament yarns used have $VS(K_F)$ of 60 to 100%.

17. The process of claim 1, wherein stabilized and size-free flat multifilament yarns having filament counts of more than 20, in particular of more than 30, are used.

18. The process of claim 1, wherein the stabilized and size-free flat multifilament yarns used are flat polyester yarns having breaking strengths of more than 2 g/denier.

19. The process of claim 7, wherein the fluctuation in the tension on the stabilized and size-free flat multifilament yarns at the site of intermingling and during the weaving is less than +/−0.1 cN/dtex.

20. The process of claim 7, wherein the yarn tension at the site of intermingling is not greater than 0.6 cN/dtex.

21. The process of claim 7, wherein the intermingled and size-free flat multifilament yarn is, after the intermingling, subsequently subjected to a setting treatment.

22. The process of claim 1, wherein the stabilized and size-free flat multifilament yarn is downstream of the site of intermingling conventionally afteroiled or afterwaxed.

23. The process of claim 1, wherein warps having thread densities of more than 30 ends/cm are used.

24. The process of claim 1, wherein single- or multicomponent weft yarns composed of polyamides, polyolefins, polyacrylonitrile, polyesters, viscose, cotton or wool or of a mixture thereof are used.

25. The process of claim 1, wherein plain, twill, satin or sateen weaves are produced.

26. The process of claim 25, wherein the weft thread densities are more than 20 picks/cm.

27. A woven fabric comprising warp threads based on stabilized flat multifilament yarns woven without size, whose warp thread density is more than 30 ends/cm and whose weft thread density is more than 20 picks/cm.

28. The fabric of claim 27, woven in twill, satin/sateen or plain weave.

29. The fabric of claim 27, comprising warp threads comprising stabilized and size-free flat multifilament yarns having filament counts of more than 20.

30. The fabric of claim 27, comprising warp threads comprising stabilized and size-free flat multifilament yarns wherein $$VS(K_F)>42\%$$

and $$(VG_{mean}/VG_{max})*100\%>45\%$$

the VG quantities being degrees of intermingling determined using the Rothschild needle tester model 2040, $VG_{mean}$ being the arithmetic $_{mean}$ of 20 needle test measurements, and $VG_{max}$ being the maximum value of 20 needle test measurements and where $VS(K_F)$ is the intermingling stability at a given total yarn tension $K_F$ determined by measuring the opening tendency of the flat multifilament yarn under dynamic-mechanical stress by the following method:

a) determining the degree of intermingling $VG_{init}$ of the flat multifilament yarn to be tested using the Rothschild needle tester R 2040, b) feeding the flat multifilament yarn into a testing zone of defined length in which the yarn path undergoes a deflection and which is formed at the beginning and end of transport devices for the yarn and of a radial force measuring device, disposed between the transport devices, the angle between the two parts of the yarn path being about 50° to about 5°, and the deflection being caused by the arrangement of the transport devices and of the radial force measuring device, and movement of the flat multifilament yarn through the testing zone under a given static yarn-pulling force, c) periodically deflecting the flat multifilament yarn moving through the testing zone at a frequency which corresponds to the change of shed frequency of a weaving machine, in particular 8 to 35 hertz, perpendicularly to the yarn axis by a predetermined length by means of a deflecting device which acts within the testing zone on the flat multifilament yarn to be tested in such a way that maximum deflection produces within the flat multifilament yarn a total yarn tension $K_F$ from 0.1 to 1.0 cN/dtex which is composed of a proportion of the static yarn-pulling force and a proportion of the dynamic yarn-pulling force acting periodically on the yarn and caused by the deflecting, d) determining the yarn-pulling force $K_F$ acting on the flat multifilament yarn during its passage through the testing zone by means of the radial force measuring device, $K_F$ being taken as the force which acts on the flat multifilament yarn between two deflections of the flat multifilament yarn due to the deflecting device, e) determining the degree of intermingling $VG_{end}$ of the yarn treated in the testing zone using the Rothschild needle tester R 2040, and f) determining the intermingling stability VS at a given yarn tension $K_F$ according to the relation $$VS(K_F)=(VG_{init}/VG_{end})*100(\%).$$

31. The fabric of claim 30, comprising warp threads comprising stabilized and size-free flat multifilament yarns wherein $$(VG_{mean}/VG_{max})*100\%>67\%.$$

32. The fabric of claim 30, comprising warp threads comprising stabilized and size-free flat multifilament yarns wherein $$VG_{mas}<30 \text{ mm},$$

where $VG_{max}$ the maximum value of 20 needle test measurements by a Rothschild needle tester R 2040.

33. The fabric of claim 30, comprising warp threads comprising stabilized and size-free flat multifilament yarns wherein $$LK_{mean}<15 \text{ mm},$$

where $LK_{mean}$ is the mean length between the intermingling nodes determined according to the relation $$LK_{mean}=(1000-(VG_{mean}*IL_{mean}))/IL_{mean}$$

where $VG_{mean}$ is the arithmetic $_{mean}$ of 20 needle test measurements and is determined via the Rothschild needle tester model 2040, and $IL_{mean}$ is the mean number of intermingling nodes per yarn meter determined using the Reutlingen Interlace Counter or an ITEMAT.

34. The fabric of claim 30, comprising warp threads comprising stabilized and size-free flat multifilament yarns having an opening tendency VS ($K_F$) of greater than or equal to 45% measured at a frequency of 15 hertz and at such a maximum deflection in step c) that the maximum deflection produces in the flat multifilament yarn a total yarn tension of up to 0.42 cN/dtex.

35. The fabric of claim 30, comprising warp threads comprising stabilized and size-free flat multifilament yarns having $(VG_{mean}/ VG_{max})*100\%$ of more than 55%.

36. The fabric of claim 30, comprising warp threads comprising stabilized and size-free flat multifilament yarns having $VG_{max}$ of less than 22 mm.

37. The fabric of claim 30, comprising warp threads comprising stabilized and size-free flat multifilament yarns having $LK_{mean}$ of 1.6 to 5.6 mm, $LK_{mean}$ is the mean length between the intermingling nodes determined according to the relation $$LK_{mean}=(1000-(VG_{mean}*IL_{mean}))/IL_{mean}$$

$VG_{mean}$ is the arithmetic mean of 20 needle test measurements and is determined via the Rothschild needle tester model 2040 and $IL_{mean}$ is the mean number intermingling nodes per yarn meter determined using the Reutlingen Interlace Counter or an ITEMAT.

38. The fabric of claim 30, comprising warp threads comprising stabilized and size-free flat multifilament yarns having $VS(K_F)$ of 60 to 100%.

39. The fabric of claim 27, comprising single- or multicomponent weft threads composed of polyamides, polyolefins, polyacrylonitrile, polyesters, viscose, cotton or wool or of a mixture thereof.

* * * * *

UNITED STATES PATENT AND TRADEMARK OFFICE

CERTIFICATE OF CORRECTION

PATENT NO. : 5,421,377

DATED : June 6, 1995

INVENTOR(S) : Burkhard Bonigh

It is certified that error appears in the above-indentified patent and that said Letters Patent is hereby corrected as shown below:

Column 2, line 37. "hots" should read -- knots --.

Column 16, line 1 (claim 11, line 8), after "1000" insert -- - ($VG_{mean}$ --.

Signed and Sealed this

Seventh Day of November, 1995

*Attest:*

*Attesting Officer*

BRUCE LEHMAN

*Commissioner of Patents and Trademarks*